US009578922B2

(12) United States Patent
Abshire

(10) Patent No.: US 9,578,922 B2
(45) Date of Patent: Feb. 28, 2017

(54) SOLE CONSTRUCTION FOR ENERGY STORAGE AND REBOUND

(75) Inventor: Danny Abshire, Boulder, CO (US)

(73) Assignee: NEWTON RUNNING COMPANY, INC., Boulder, CO (US)

( * ) Notice: Subject to any disclaimer, the term of this patent is extended or adjusted under 35 U.S.C. 154(b) by 1688 days.

(21) Appl. No.: 12/513,833

(22) PCT Filed: Nov. 6, 2007

(86) PCT No.: PCT/US2007/083818

§ 371 (c)(1),
(2), (4) Date: May 6, 2009

(87) PCT Pub. No.: WO2008/058147

PCT Pub. Date: May 15, 2008

(65) Prior Publication Data

US 2010/0031530 A1 Feb. 11, 2010

Related U.S. Application Data

(60) Provisional application No. 60/857,089, filed on Nov. 6, 2006.

(51) Int. Cl.

| | |
|---|---|
| ***A43B 13/18*** | (2006.01) |
| ***A43B 13/12*** | (2006.01) |
| ***A43B 21/26*** | (2006.01) |

(52) U.S. Cl.

CPC ..... *A43B 13/181* (2013.01); *A43B 21/26* (2013.01)

(58) Field of Classification Search

CPC ..... A43B 21/26; A43B 13/181; A43B 13/183; A43B 13/185; A43B 13/143; A43B 13/145; A43B 13/18; A43B 13/12; A43B 13/125; A43B 7/223

(Continued)

(56) References Cited

U.S. PATENT DOCUMENTS 1,382,180 A 6/1921 Emery
1,778,089 A 10/1930 Pomerantz (Continued)

FOREIGN PATENT DOCUMENTS

DE A35 07 295 4/1986
DE 40 15 138 A1 11/1994

(Continued)

OTHER PUBLICATIONS

International Search Report for PCT/US2007/083818 dated Jun. 11, 2007.

(Continued)

*Primary Examiner* — Jila M Mohandesi
(74) *Attorney, Agent, or Firm* — Holzer Patel Drennan

(57) ABSTRACT

A sole construction (110, 310, 410, 510) for supporting at least a portion of a foot and for providing energy storage and return is provided. The sole construction (110, 310, 410, 510) includes a generally horizontal layer (126, 156, 326, 356, 426, 456, 526, 556) of stretchable material, at least one chamber (130, 132, 134, 330, 332, 334, 354, 354', 430, 432, 434, 454, 454', 530, 532, 534, 554, 554') positioned adjacent a first side of the layer (126, 156, 326, 356, 426, 456, 526, 556), and at least one actuator (122, 158, 320, 322, 324, 358, 420, 422, 424, 458, 520, 522, 524, 558) positioned adjacent a second side of the layer (126, 156, 326, 356, 426, 456, 526, 556) vertically aligned with a corresponding chamber (130, 132, 134, 330, 332, 334, 354, 354', 430, 432, 434, 454, 454', 530, 532, 534, 554, 554'). The sole (110, 310, 410, 510) when compressed causes the actuator (122, 158, 320, 322, 324, 358, 420, 422, 424, 458, 520, 522, 524, 558) to push against the layer (126, 156, 326, 356, 426, 456, 526, 556) and move the layer (126, 156, 326, 356, 426, 456, 526, 556) at least partially into the corresponding chamber (130, 132, (Continued)

134, 330, 332, 334, 354, 354', 430, 432, 434, 454, 454', 530, 532, 534, 554, 554').

20 Claims, 16 Drawing Sheets

(58) Field of Classification Search
USPC ..... 36/28, 27, 29, 25 R, 103, 31
See application file for complete search history.

(56) References Cited

U.S. PATENT DOCUMENTS

| | | | |
|---|---|---|---|
| 1,993,208 | A | 3/1935 | Cohn |
| 2,058,975 | A | 10/1936 | Gray |
| 2,549,343 | A | 4/1951 | Stoiner |
| 2,811,791 | A | 11/1957 | Cox |
| 3,086,532 | A | 4/1963 | Mistarz |
| 3,100,354 | A | 8/1963 | Lombard et al. |
| 3,290,801 | A | 12/1966 | Bente |
| 3,402,485 | A | 9/1968 | McMorrow |
| 3,834,046 | A | 9/1974 | Fowler |
| 4,187,620 | A | 2/1980 | Selner |
| 4,259,792 | A | 4/1981 | Halberstadt |
| 4,266,349 | A | 5/1981 | Schmohl |
| 4,335,530 | A | 6/1982 | Stubblefield |
| 4,372,058 | A | 2/1983 | Stubblefield |
| 4,785,557 | A | 11/1988 | Kelly |
| 4,798,009 | A | 1/1989 | Colonel et al. |
| 4,798,010 | A | 1/1989 | Sugiyama |
| 4,843,735 | A | 7/1989 | Nakanishi |
| RE33,066 | E | 9/1989 | Stubblefield |
| 4,888,887 | A | 12/1989 | Solow |
| 4,897,937 | A | 2/1990 | Misevich et al. |
| 4,922,631 | A | 5/1990 | Anderie |
| 4,956,927 | A | 9/1990 | Misevich et al. |
| 4,999,931 | A | 3/1991 | Vermeulen |
| 5,005,299 | A | 4/1991 | Whatley |
| D321,975 | S | 12/1991 | Arnulf et al. |
| 5,083,910 | A | 1/1992 | Abshire et al. |
| 5,092,060 | A | 3/1992 | Frachey et al. |
| D326,956 | S | 6/1992 | Damianoe et al. |
| D331,832 | S | 12/1992 | Issler |
| 5,185,943 | A | 2/1993 | Tong |
| 5,195,257 | A | 3/1993 | Holcomb et al. |
| 5,224,277 | A | 7/1993 | Sang Do |
| D343,272 | S | 1/1994 | James |
| D347,105 | S | 5/1994 | Johnson |
| 5,311,680 | A | 5/1994 | Comparetto |
| 5,319,866 | A | 6/1994 | Foley et al. |
| 5,343,639 | A | 9/1994 | Kilgore et al. |
| 5,367,791 | A | 11/1994 | Gross et al. |
| 5,384,973 | A | 1/1995 | Lyden |
| 5,440,826 | A | 8/1995 | Whatley |
| 5,465,507 | A | 11/1995 | Schumacher et al. |
| 5,560,126 | A | 10/1996 | Meschan et al. |
| 5,595,003 | A | 1/1997 | Snow |
| 5,598,645 | A | 2/1997 | Kaiser |
| 5,615,497 | A | 4/1997 | Meschan |
| 5,625,963 | A | 5/1997 | Miller et al. |
| 5,647,145 | A | 7/1997 | Russell et al. |
| 5,718,063 | A | 2/1998 | Yamashita et al. |
| 5,797,199 | A | 8/1998 | Miller et al. |
| 5,806,210 | A | 9/1998 | Meschan |
| 5,815,949 | A | 10/1998 | Sessa |
| 5,822,886 | A | 10/1998 | Luthi et al. |
| 5,826,352 | A | 10/1998 | Meschan et al. |
| 5,832,634 | A | 11/1998 | Wong |
| 5,918,384 | A | 7/1999 | Meschan |
| 5,937,544 | A | 8/1999 | Russell |
| 6,038,790 | A | 3/2000 | Pyle et al. |
| 6,061,929 | A | 5/2000 | Ritter |
| 6,065,229 | A | 5/2000 | Wahrheit |
| 6,076,282 | A | 6/2000 | Brue |
| 6,098,313 | A | 8/2000 | Skaja |
| 6,195,915 | B1 | 3/2001 | Russell |
| 6,199,302 | B1 | 3/2001 | Kayano |
| 6,233,846 | B1 | 5/2001 | Sordi |
| 6,266,897 | B1 | 7/2001 | Seydel et al. |
| 6,314,664 | B1 | 11/2001 | Kita et al. |
| 6,327,795 | B1 * | 12/2001 | Russell ..... A43B 7/223 36/27 |
| 6,330,757 | B1 | 12/2001 | Russell |
| 6,354,020 | B1 | 3/2002 | Kimball et al. |
| 6,389,713 | B1 | 5/2002 | Kita |
| 6,393,732 | B1 | 5/2002 | Kita |
| 6,401,365 | B2 | 6/2002 | Kita et al. |
| 6,412,196 | B1 | 7/2002 | Gross |
| 6,438,870 | B2 | 8/2002 | Nasako et al. |
| 6,457,261 | B1 | 10/2002 | Crary |
| 6,516,540 | B2 | 2/2003 | Seydel et al. |
| 6,598,320 | B2 | 7/2003 | Turner et al. |
| 6,604,300 | B2 | 8/2003 | Meschan |
| 6,647,645 | B2 | 11/2003 | Kita |
| 6,662,471 | B2 | 12/2003 | Meschan |
| 6,694,642 | B2 | 2/2004 | Turner |
| 6,701,643 | B2 | 3/2004 | Geer et al. |
| 6,745,499 | B2 | 6/2004 | Christensen et al. |
| 6,842,999 | B2 | 1/2005 | Russell |
| 6,880,266 | B2 | 4/2005 | Schoenborn et al. |
| 6,883,253 | B2 | 4/2005 | Smith et al. |
| 6,898,870 | B1 | 5/2005 | Rohde |
| 6,962,008 | B2 | 11/2005 | Manz et al. |
| 6,964,120 | B2 | 11/2005 | Cartier et al. |
| 6,968,636 | B2 | 11/2005 | Aveni et al. |
| 7,013,582 | B2 | 3/2006 | Lucas et al. |
| 7,020,988 | B1 | 4/2006 | Holden et al. |
| 7,020,990 | B2 | 4/2006 | Khoury |
| 7,036,245 | B2 | 5/2006 | Russell |
| 7,059,067 | B2 | 6/2006 | Geer et al. |
| 7,080,467 | B2 | 7/2006 | Marvin et al. |
| 7,082,700 | B2 | 8/2006 | Meschan |
| 7,089,689 | B2 | 8/2006 | Meschan |
| 7,096,605 | B1 | 8/2006 | Kozo et al. |
| 7,100,310 | B2 | 9/2006 | Foxen et al. |
| 7,114,269 | B2 | 10/2006 | Meschan |
| 7,168,186 | B2 | 1/2007 | Russell |
| 7,331,124 | B2 | 2/2008 | Meschan |
| 7,337,559 | B2 | 3/2008 | Russell |
| 7,380,353 | B2 * | 6/2008 | Feller ..... A43B 1/0072 36/108 |
| 904,891 | A1 | 11/2008 | Otterstedt |
| 7,555,845 | B2 | 7/2009 | Critelli et al. |
| 7,621,058 | B2 | 11/2009 | Durand |
| 7,726,042 | B2 | 6/2010 | Meschan |
| 2001/0010129 | A1 | 8/2001 | Russell |
| 2002/0023374 | A1 | 2/2002 | Russell |
| 2002/0157280 | A1 | 10/2002 | Russell |
| 2004/0006891 | A1 | 1/2004 | Russell |
| 2004/0123493 | A1 | 7/2004 | Russell |
| 2005/0091881 | A1 | 5/2005 | Burgess |
| 2005/0193589 | A1 | 9/2005 | Bann |
| 2005/0262729 | A1 | 12/2005 | Manz et al. |
| 2006/0042120 | A1 | 3/2006 | Sokolowski et al. |
| 2006/0137220 | A1 | 6/2006 | Hardy et al. |
| 2006/0156581 | A1 | 7/2006 | Holden et al. |
| 2007/0144037 | A1 | 6/2007 | Russell |
| 2008/0263895 | A1 | 10/2008 | Russell |
| 2010/0005685 | A1 | 1/2010 | Russell |
| 2010/0115791 | A1 | 5/2010 | Russell |

FOREIGN PATENT DOCUMENTS

| | | |
|---|---|---|
| EP | 0 578 618 B1 | 3/1998 |
| IT | A666436 | 8/1964 |
| JP | 2004-065978 A | 2/2004 |
| JP | 5355409 A | 9/2013 |
| JP | 2807939 A1 | 3/2014 |
| WO | WO 90/12518 | 11/1990 |
| WO | WO 92/03069 | 3/1992 |
| WO | WO 93/03639 | 3/1993 |
| WO | WO 96/39061 | 12/1996 |
| WO | WO 99/35928 | 7/1999 |

(56) References Cited

FOREIGN PATENT DOCUMENTS

| | | |
|---|---|---|
| WO | WO 00/10417 | 3/2000 |
| WO | WO 02/078480 | 10/2002 |
| WO | WO 03/105619 | 12/2003 |

OTHER PUBLICATIONS

Affidavit of Jerry Turner, Civil Action No. 1:03 cv 01207, *Akeva, LLC.*, v. *Adidas America, Inc.* and Attachment A—1991 advertisement for the TURNTEC A.R.T System.
U.S. Appl. No. 12/690,023, filed Jan. 19, 2010.

* cited by examiner

SOLE CONSTRUCTION FOR ENERGY STORAGE AND REBOUND

CROSS-REFERENCE TO RELATED APPLICATION

This application is the U.S. National Phase under 35 U.S.C. §371 of International Application PCT/US2007/083818, filed Nov. 6, 2007, which claims the benefit of U.S. Provisional Application No. 60/857,089, filed Nov. 6, 2006, the entirety of all of which is hereby incorporated by reference.

BACKGROUND OF THE INVENTION

Field of the Invention

The present invention generally relates to articles of footwear, and more particularly, to sole constructions that may be incorporated into athletic footwear or as an insert into existing footwear and the like in order to store kinetic energy generated by a person. The sole construction has a combination of structural features enabling enhanced storage, retrieval and guidance of wearer muscle energy that complement and augment performance of participants in recreational and sports activities.

Description of the Related Art

In typical walking and running gaits, one foot contacts a support surface (such as the ground) in a stance mode while the other foot moves through the air in a swing mode. During the stance mode, the foot in contact with the support surface travels through three successive basic phases: heel strike, mid stance and toe off. The heel strike is eliminated with faster paced running and proper running form.

Running shoe designers have sought to strike a compromise between providing enough cushioning to protect the runner's foot, but not so much that the runner's foot will wobble and get out of sync with the working of the knee and lower body alignment. Typical shoe designs fail to adequately address the needs of the runner's foot and ankle during each of the stages of the stance mode resulting in the loss of a significant proportion, by some estimates at least thirty percent, of the foot and ankle's functional abilities, including their abilities to absorb shock, load musculature and tendon systems, and to propel the runner's body forward.

Another perplexing problem has been how to store the energy generated while running, jumping, etc. Traditional shoe designs have merely dampened the shock thereby dissipating the kinetic energy. Rather than losing the kinetic energy, it is useful to store and retrieve that energy while allowing the feet greater sensory perception, as in barefoot running, to enhance athletic performance. Traditional shoe construction, however, has failed to address this need.

Therefore, there remains a need for a shoe sole that will provide sufficient cushioning, adequate stabilizing support, and enhanced storage, retrieval and guidance of a runner's energy in a way that will complement and augment the runner's performance.

SUMMARY OF THE INVENTION

This application relates in certain embodiments to sole constructions that store energy when a compressive weight is placed thereon and which release that energy when the weight is taken off. The sole construction may comprise the entire structure underlying the upper of a shoe, such that the sole construction underlies the heel, metatarsal and toe regions of a wearer's foot, or may comprise just portions of the sole. The sole construction may comprise one or more of the embodiments described below in various combinations to provide desired properties. Shoes using one or more sole constructions as described herein, incorporated either during manufacture or used as an insert, are contemplated as being within the scope of the present application.

In one embodiment, a sole or sole portion for cushioning, supporting and providing energy return to a heel region includes a foundation, one or more actuators, an elastic membrane engaged by the actuators on a first side thereof, and a heel layer having one or more chambers on a second side of the elastic membrane. The sole may further include a rigid top plate above the foundation layer. The foundation layer may have a central aperture to allow an actuator to be actuated with reduced resistance from the foundation layer. The foundation layer may have one or more recesses to receive one or more actuators. For example, a central actuator may be used along with medical and lateral actuators, which in one embodiment may be positioned above the elastic membrane. The one or more actuators may have a slightly dome-shaped bottom surface. The elastic membrane may be pretensioned by one or more actuators.

In one embodiment, a sole or sole portion for cushioning, supporting and providing energy return to a metatarsal region includes a foundation layer overlying a lining layer having chambers, an elastic membrane covering the chambers, and actuators engaging the chambers through the elastic membrane. The chambers underlie or substantially underlie the metatarsal region, and may at least be in part defined within the foundation layer. The sole may further include a rigid top plate above the foundation layer. The sole may further include stiffening elements located within each actuator, or between each actuator and the elastic membrane.

In one embodiment, a sole for cushioning, supporting and providing energy return to a toe region includes a foundation layer overlying a lining layer having chambers, an elastic membrane covering the chambers, and actuators engaging the chambers through the membrane.

Another embodiment of a sole for cushioning, supporting and providing energy return to a toe region includes a foundation layer having generally wedge-shaped pads configured to provide a smooth transition from the metatarsal region.

In one embodiment, a sole or sole portion for cushioning, supporting and providing energy return to a foot includes a flex region between the metatarsal region and the toe region.

In one embodiment, a sole or sole portion for cushioning, supporting and providing energy return to a foot including a foundation layer of variable density foam having a region of increased hardness relative to other regions.

In one embodiment, a sole construction for cushioning, supporting and providing energy return to a region of a foot comprises a foundation layer defining a central recess and peripheral recesses. A central actuator is positioned in the central recess of the foundation layer. Peripheral actuators are positioned in the peripheral recesses of the foundation layer. An elastic membrane is engaged by the actuators on a first side thereof. A heel layer having a plurality of chambers is on a second side of the elastic membrane, the chambers being vertically aligned with the central and peripheral actuators.

In one embodiment, a sole construction for cushioning, supporting and providing energy return to a region of a foot comprises a foundation layer defining a plurality of bottom facing chambers elongated in a generally posterior-to-anterior direction. An elastic membrane covers the chambers. A plurality of actuators engages the chambers through the elastic membrane. The plurality of actuators is elongated in a generally posterior-to-anterior direction.

In one embodiment, a sole construction comprises at least one elastic membrane, at least one chamber positioned on a first side of the at least one elastic membrane, and at least one actuator that corresponds to the at least one chamber and is positioned on a second side of the at least one elastic membrane. The at least one actuator and the at least one chamber are sized and positioned such that the at least one chamber at least partially receives a portion of the at least one elastic membrane when the at least one actuator is compressed against the at least one elastic membrane. The chamber has a depth of about 5 mm or more.

In one embodiment, a sole construction comprises at least one elastic membrane, at least one chamber positioned on a first side of the at least one elastic membrane, and at least one actuator that corresponds to the at least one chamber and is positioned on a second side of the at least one elastic membrane. The at least one actuator is elongated and has a first end and a second end. The at least one actuator and the at least one chamber are sized and positioned such that the at least one chamber at least partially receives a portion of the at least one elastic membrane when the at least one actuator is compressed against the at least one elastic membrane and the first end of the at least one actuator enters the at least one chamber before the second end of the at least one actuator and the first end rebounds out of the at least one chamber before the second end as pressure is transferred from one region of a user's foot to another.

In one embodiment, a sole construction comprises, a foundation layer, a lining layer extending over at least a portion of the foundation layer and having at least one chamber, and at least one elastic membrane. The foundation layer and the lining layer are positioned on a first side of the at least one elastic membrane. At least one actuator corresponds to the at least one chamber and is positioned on a second side of the at least one elastic membrane. The at least one actuator and the at least one chamber are sized and positioned such that the at least one chamber at least partially receives a portion of the at least one elastic membrane when the at least one actuator is compressed against the at least one elastic membrane.

In one embodiment, a sole construction comprises at least one elastic membrane, at least one chamber positioned on a first side of the at least one elastic membrane, and at least one actuator that corresponds to the at least one chamber and is positioned on a second side of the at least one elastic membrane. The at least one actuator and the at least one chamber are sized and positioned such that the at least one chamber at least partially receives a portion of the at least one elastic membrane when the at least one actuator is compressed against the at least one elastic membrane. The at least one actuator engages and pretensions the at least one elastic membrane.

In one embodiment, a sole construction comprises at least one elastic membrane, a central chamber and one or more peripheral chambers positioned on a first side of the at least one elastic membrane, and a central actuator and one or more peripheral actuators that correspond to the central chamber and one or more peripheral chambers and are positioned on a second side of the at least one elastic membrane. The actuators and the chambers are sized and positioned such that the chambers at least partially receive portions of the at least one elastic membrane when the actuators are compressed against the at least one elastic membrane. The one or more peripheral chambers and the one or more actuators are configured to inhibit rolling of the foot in a direction away from the central chamber and the central actuator toward the one or more peripheral chambers and the one or more actuators.

In one embodiment, a sole comprises a layer having at least one chamber and being integrally formed with an elastic membrane. The at least one chamber is positioned on a first side of the at least one elastic membrane. At least one actuator corresponds to the at least one chamber and is positioned on a second side of the at least one elastic membrane. The at least one actuator and the at least one chamber are sized and positioned such that the at least one chamber at least partially receives a portion of the at least one elastic membrane when the at least one actuator is compressed against the at least one elastic membrane.

In one embodiment, a sole construction comprises at least one elastic membrane and a foundation layer having at least one chamber. The at least one chamber is positioned on a first side of the at least one elastic membrane. At least one actuator corresponds to the at least one chamber and is positioned on a second side of the at least one elastic membrane. The at least one actuator and the at least one chamber are sized and positioned such that the at least one chamber at least partially receives a portion of the at least one elastic membrane when the at least one actuator is compressed against the at least one elastic membrane. The foundation layer has a flex region that comprises at least one upper groove and at least one lower groove. The at least one upper groove and the at least one lower groove extend in a general lateral-to-medial direction.

BRIEF DESCRIPTION OF THE DRAWINGS

Further objects, features and advantages of the invention will become apparent from the following detailed description taken in conjunction with the accompanying figures showing illustrative embodiments of the invention, in which:

FIG. 6A is a cross-sectional view of the heel of the sole construction of FIGS. 3A and 3B. FIG. 6B is a cross-sectional view of the heel of the sole construction of FIGS. 4A and 4B. FIG. 6C is a cross-sectional view of the heel of the sole construction of FIGS. 5A and 5B.

DETAILED DESCRIPTION OF CERTAIN PREFERRED EMBODIMENTS

The embodiments described below relate to sole constructions that store energy when a compressive pressure is placed thereon and which release that energy when the weight is taken off. Some embodiments can include one or more features described in connection with one or more of the embodiments described herein. Sole constructions having features that may be useful and may be combined with the sole constructions described herein may be found in U.S. Pat. Nos. 5,647,145, 6,327,795 and 7,036,245, and U.S. Publication No. 2004/0123493 published Jul. 1, 2004, the entirety of each of which is hereby incorporated by reference. In the following description, similar references numerals are used to designate similar components in the different embodiments. Additionally, some embodiments can include one or more features described in connection with one or more of the embodiments described herein.

Figure 1:
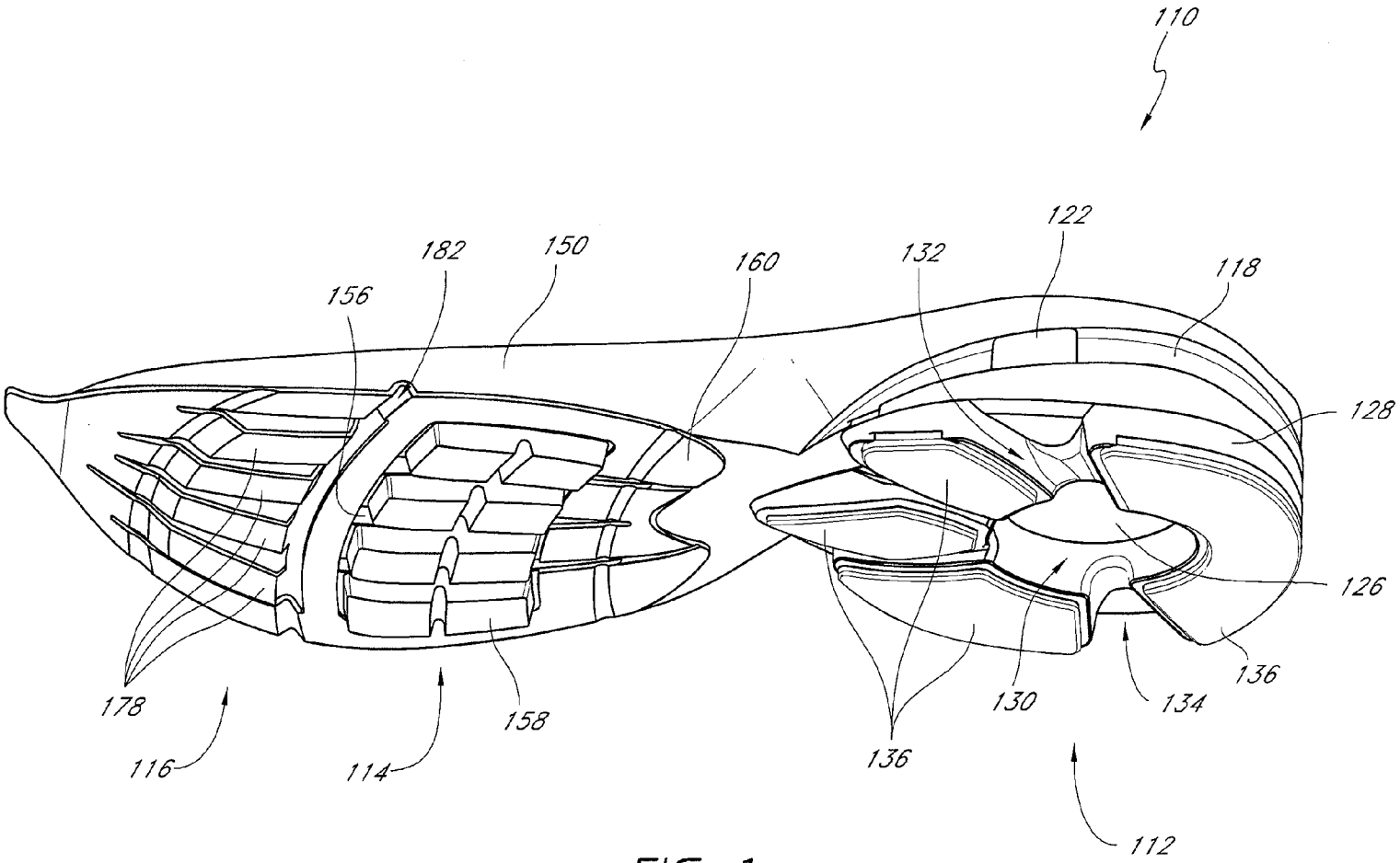
FIG. 1 is a perspective view of a sole construction in accordance with one embodiment.
Figure 3A:
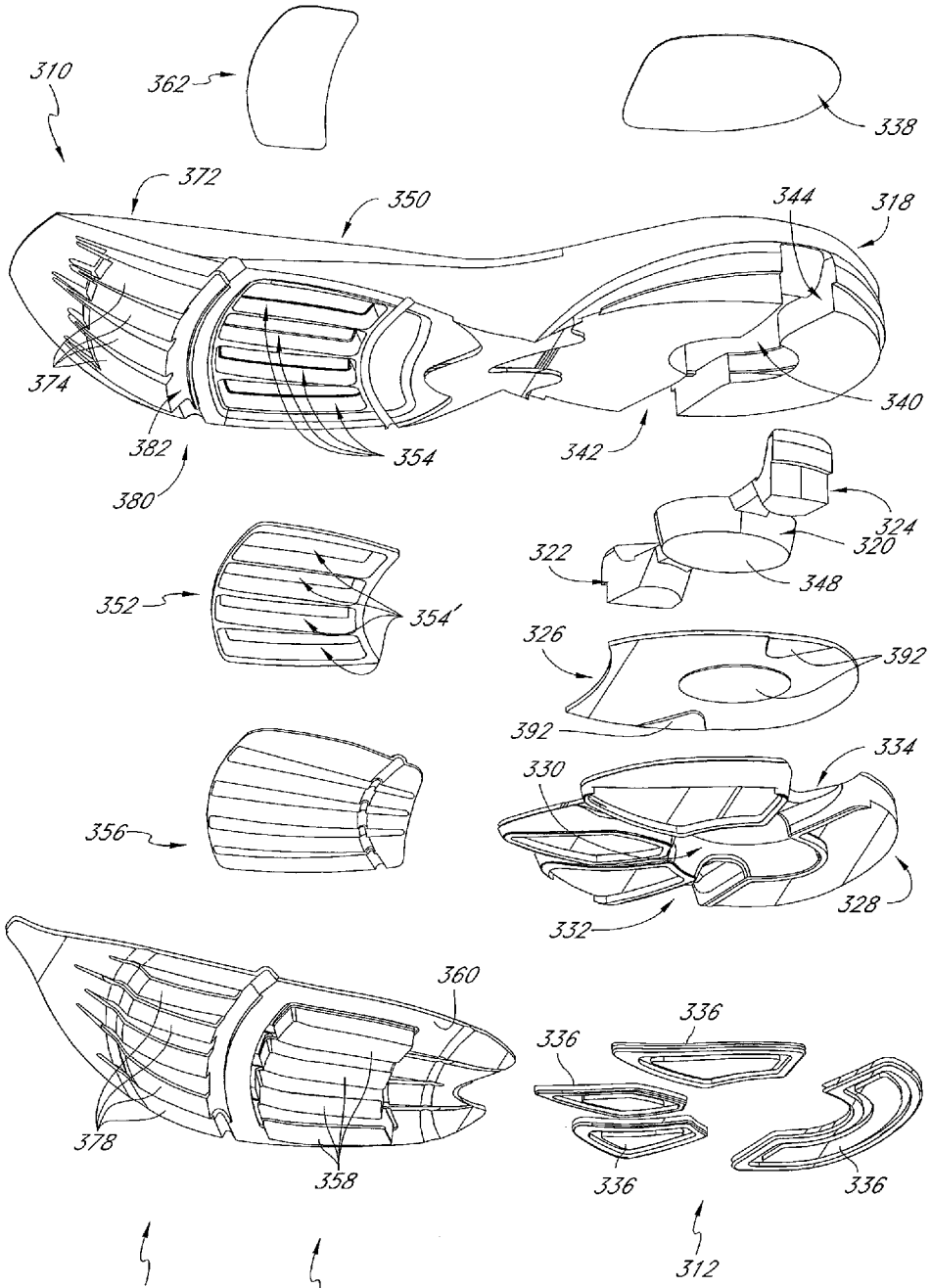
FIG. 3A is an exploded bottom perspective view of a sole construction similar to FIG. 1 in accordance with one embodiment.
Figure 3B:
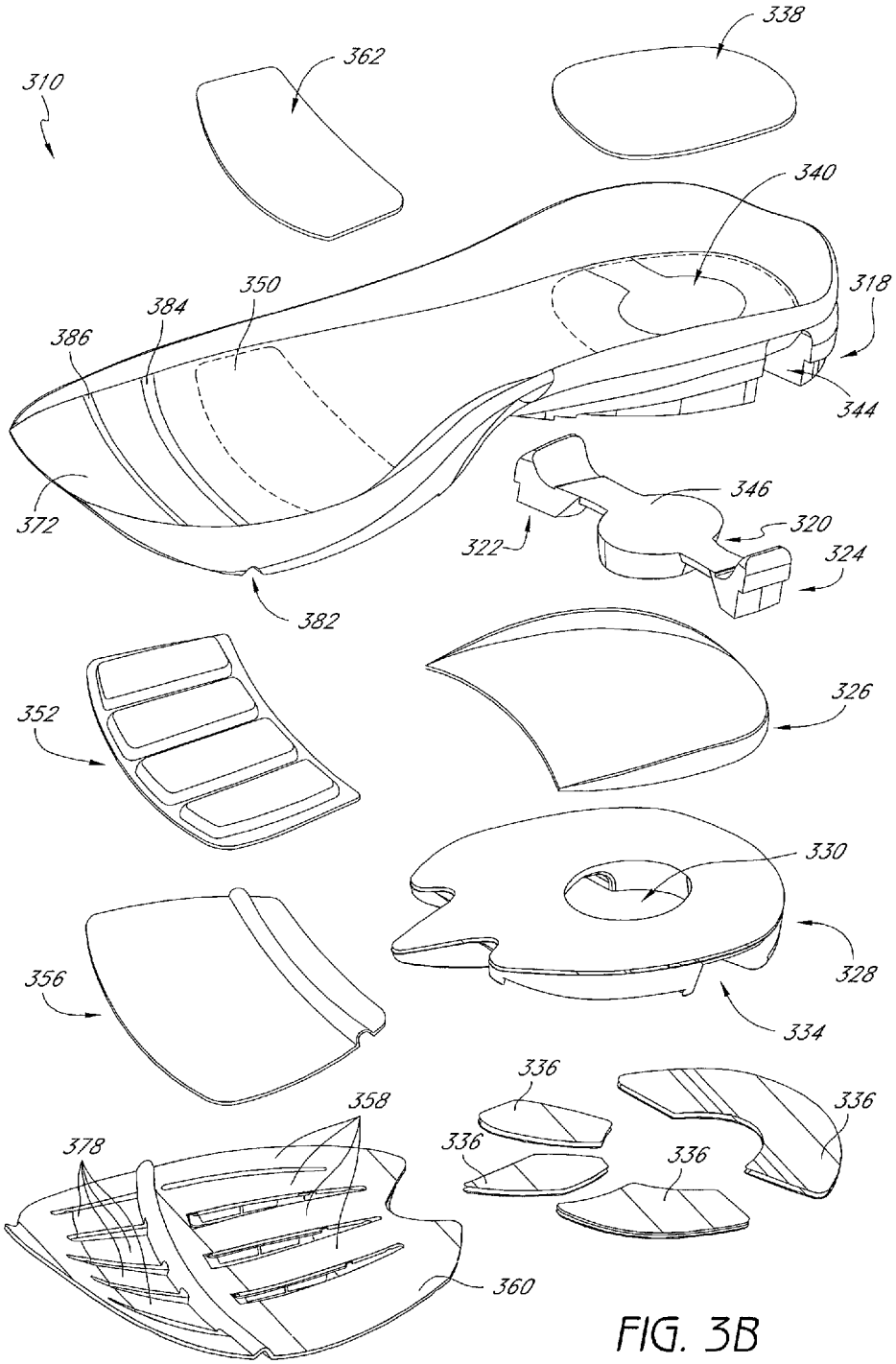
FIG. 3B is an exploded top perspective view of the sole construction of FIG. 3A.

In one embodiment, a sole 110 includes a heel region 112, a metatarsal region 114 and a toe region 116 as shown in FIG. 1. Referring to FIGS. 3A and 3B, the heel region 312 preferably includes a foundation layer 318, actuators 320, 322, 324, below or within the foundation layer, an elastic membrane 326 below the actuators, a heel layer 328 below the elastic membrane, chambers 330, 332, 334 within or defined by the heel layer, and ground engaging elements 336 on the heel layer. Optionally, top plate 338 may be provided above the foundation layer, as shown in FIG. 3B. The heel region preferably underlies or substantially underlies the entire width of a heel of a wearer's foot.

The foundation layer 318 includes an upper surface (shown in FIG. 3B) sized and configured to receive and cradle a wearer's foot, and may preferably have a central aperture 340 and recesses 342 and 344 (shown in FIGS. 3A and 3B) and may be made of foam or other resilient material. The central aperture 340, in one embodiment, allows the central actuator 320 to be actuated therein with reduced resistance from foundation layer 318. The lateral recess 342 and medial recess 344 preferably receive the lateral actuator 322 and medial actuator 324, respectively. The central aperture 340 in one embodiment has a generally oval shape, and may be open to the lateral and medial recesses 342 and 344, which may be open to the sides of the foundation layer and have a generally triangular shape, as shown in FIG. 3A.

Referring to FIGS. 3A and 3B, the central actuator 320 underlies the heel bone and includes a top surface 346 and a bottom surface 348. The top surface 346 may be generally flat or, in some embodiments, may be contoured. The bottom surface 348 may be convex or slightly dome-shaped, but may be otherwise contoured or flat in some embodiments. The dome shape of the bottom surface 348, in one embodiment, allows the actuator to mimic the bone's interaction with an underlying surface thereby improving proprioception of the ankle system. The central actuator 320, in one embodiment, engages and may preferably pretension the elastic membrane 326, as described below.

The central actuator 320 and the peripheral actuators 322 and 324 may be manufactured as an integral component to reduce manufacturing costs, but the actuators 320, 322 and 324 may also be multiple pieces. The peripheral actuators 322 and 324 may be generally triangular in shape to generally mate with the respective recesses 342 and 344, as illustrated in FIGS. 3A and 3B. Preferably, the central and peripheral actuators span substantially the entire width of a natural human foot. Under pressure from a heel bone, actuators 322 and 324 engage elastic membrane 326 and move into chambers 332 and 334, respectively. In addition, the actuators 322 and 324 may pretension the elastic membrane 326.

The peripheral actuators 322 and 324, in one embodiment, provide stability to the foot and ankle during the ground engaging mode of the gait cycle by inhibiting further roll if the heel bone rolls too far from center medially or laterally. For example, the peripheral actuators 322 and 324 in cooperation with the peripheral chambers 342 and 344 and corresponding regions of the elastic membrane 326 may resist actuation more than the central actuator 320, the central chamber 330 and the corresponding region of the elastic membrane 326, thereby tending to prevent rolling of the heel bone medially or laterally. In one embodiment shown in FIGS. 3A and 3B, the lateral actuator 322 may be located forward from central actuator 320 to prevent excess rotation of the foot in the lateral direction during a midfoot strike. The medial actuator 324 may be located rearward from the central actuator 320 to provide additional guidance to the foot and ankle as they move through heel strike and mid stance.

In some embodiments, the number, locations, sizes, and shapes of the peripheral actuators will vary from the above description and will depend on the medial and lateral stability needs the particular footwear is addressing. More than one peripheral actuator may be used on either the lateral or medial side, or both. For example, in one embodiment a sole may have two actuators on the medial side, and two actuators on the lateral side.

The elastic membrane 326 underlies the actuators 320, 322 and 324, as shown in FIGS. 3A and 3B, and may span the entire width or substantially the entire width of a natural human foot. The elastic membrane 326 also preferably underlies all or substantially all of a natural human heel, in both side-to-side and posterior-to-anterior directions. The elastic membrane may be made of any highly resilient elastic material such as rubber, synthetic rubber, DuPont Hytrel™, and highly resilient elastic foams. The elastic response of the membrane 326 depends on its durometer and thickness. In a preferred embodiment, the membrane 326 is 1.5 mm thick DuPont Hytrel™.

Figure 6A:
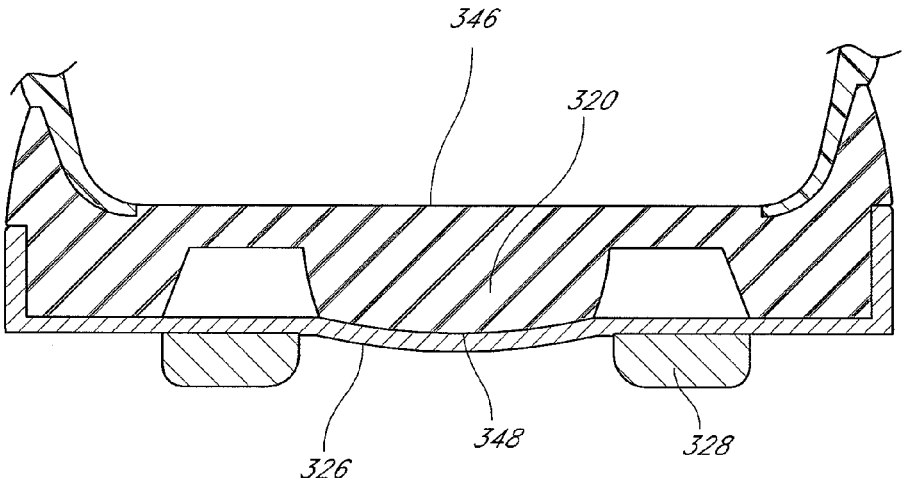
FIGS. 6A-6C are alternative cross-sectional views taken along the line 6-6 shown in FIG. 2.

The elastic membrane 326 may be pretensioned by the central actuator 320, such that the central portion of the membrane 326 is stretched downward when the sole is constructed, as shown in FIG. 6A. Pretensioning ensures contact of the actuator 320 with the membrane 326 before heel strike to provide a quick elastic response upon impact. Alternatively or additionally, the peripheral actuators may also pretension in the membrane. In some embodiments, the thickness of the elastic membrane 326 may range between about 0.5 mm or less to about 4 mm or more, including 1 mm, 2 mm, and 3 mm. The elastic membrane 326 may range in hardness from about 320 to about 45 Shore D, including 25, 30, 35, and 40 Shore D. The selection of hardness and thickness depends on the particular application of the shoe, including the weight of the wearer and the desired range of travel of the actuators into the chambers. Additionally, the thickness of the membrane 326 may vary across its length and width.

In some embodiments, the elastic membrane 326 may include regions 392 of increased thickness. For example, a region 392 may generally correspond to the shape and location of a chamber may be thicker than other areas of the membrane 326. A thickened region 392 of the membrane 326 may be either uniformly thick or the thickness may vary across the length or breadth of the region, or both.

In one embodiment, the elastic membrane 326 and the heel layer 328 are separate pieces, as shown in FIGS. 3A and 3B. The elastic membrane 326 may include a rim extending around the perimeter of the elastic membrane 326 to resist displacement of the perimeter as the membrane 326 is stretched. This rim may include a downwardly extending wall or thickened periphery of the elastic membrane that surrounds the heel layer, an upwardly extending wall or thickened periphery that surrounds the foundation layer, or both. In another embodiment, shown in FIGS. 4A and 4B, the elastic membrane 426 and the heel layer 428 may be integrally formed using a highly responsive elastomeric foam or EVA that may have a hardness of about 50 Shore C or less to about 65 Shore C or more. The regions comprising the elastic membrane 426 may range in thickness from about 1 mm or less to about 3 mm or more. In other embodiments, the elastic membrane 526 may comprise two separate portions: a first covering one or more chambers, such as peripheral chambers 532 and 534, may be formed integrally with the heel layer, while a second portion of the elastic membrane 526 may cover one or more other chambers, such as a central chamber 530, as shown in accordance with one embodiment in FIGS. 5A and 5B.

Referring again to FIGS. 3A and 3B, the heel layer 328 may comprise one or more pieces, and may be composed of foam or other resilient material. In one embodiment, the heel layer 328 is composed of EVA foam. In some embodiments, the hardness of heel layer 328 may range from about 50 Shore C or less to about 70 Shore C or more, including 55, 60 and 65 Shore C. The hardness of heel layer 328 may, in some embodiments, be generally equal to that of foundation layer 318. In other embodiments, the heel layer 328 may be either harder or softer than the foundation layer 318. In one preferred embodiment, the heel layer 328 has a hardness of about 65 Shore C, while the foundation layer 318 has a hardness of about 58 Shore C.

The heel layer 328 may have a generally annular shape and provide a central chamber 330 and peripheral chambers 332 and 334. The chambers 330, 332 and 334 may be located adjacent to the elastic membrane 326 such that the elastic membrane 326 may enter chambers 330, 332 and 334 when displaced by the actuators 320, 322 and 324. To reduce weight, the chambers 330, 332 and 334 are open on the bottom. However, in some embodiments, the chambers 330, 332 and 334 the chambers may be closed on the bottom. The heel layer preferably spans the entire width or substantially the entire width of a wearer's heel.

The central chamber 330 may have a generally oval shape in one embodiment, with the peripheral chambers 332 and 334 being generally triangular in shape and open to the sides. As pressure is applied to the heel region 312, one or more of the actuators 320, 322 and 324 preferably displace the elastic membrane 326. As the foot moves forward, pressure is released from the heel region 312 and the membrane 326 preferably has sufficient elasticity to rebound back to its original position.

The top plate 338, as shown in FIG. 3B, is preferably located above foundation layer 318. As illustrated, the central actuator 320 may be visible through the upper surface of the foundation layer, whereas the peripheral actuators 322 and 324 may be covered along their top surface by the material of the foundation layer. The top plate 338 may be made of carbon fiber, thermoplastic urethane (TPU) or other rigid, but flexible materials, or of less rigid stretchable materials. Materials that are relatively rigid may be used to improve energy return by forcing the expansion and energy return to work from the ground up, while less rigid stretchable materials may be used to improve cushioning. In other embodiments, the top plate 338 may be omitted to reduce weight.

Ground engaging elements 336 may be applied at one or more locations on the bottom surface of the heel layer 328. The ground engaging elements 336 may be composed of rubber or other durable material and may be formed as a single piece or as multiple pieces. In some embodiments, the ground engaging elements 336 may be omitted or formed integrally with the heel layer 328.

Referring to FIGS. 5A-5B and 7-8, the sole 510 includes a metatarsal region 514 positioned forward or anterior to the heel region 512. More preferably, the metatarsal region is positioned to underlie or substantially underlie the metatarsal bones of a wearer's foot, both side-to-side and posterior-to-anterior. The metatarsal region 514 preferably includes a foundation layer 550, a lining layer 552, chambers 554 in the foundation layer, chambers 554' in the lining layer, an elastic membrane 556 beneath the chambers 554 and 554', actuators 558 corresponding to chambers 554 and 554' beneath the elastic membrane, a webbing 560, and a top plate 562 above the foundation layer.

The foundation layer 550 may be composed of foam or other resilient material. In some embodiments, an elastomeric viscous foam or gel may be used. In a preferred embodiment, the foundation layer 550 is about 3 mm thick. Alternatively, the foundation layer may be about 1 mm or less to about 5 mm or more thick. The hardness of the foundation layer 550 may range from about 50 Shore C or less to about 70 Shore C or more, including 55, 60 and 65 Shore C. In one embodiment, the foundation layer 550 is composed of EVA having a hardness of about 58 Shore C. As illustrated, the foundation layer 550 may be integral with the foundation layer 518 forming part of the heel region described above.

Figure 5A:
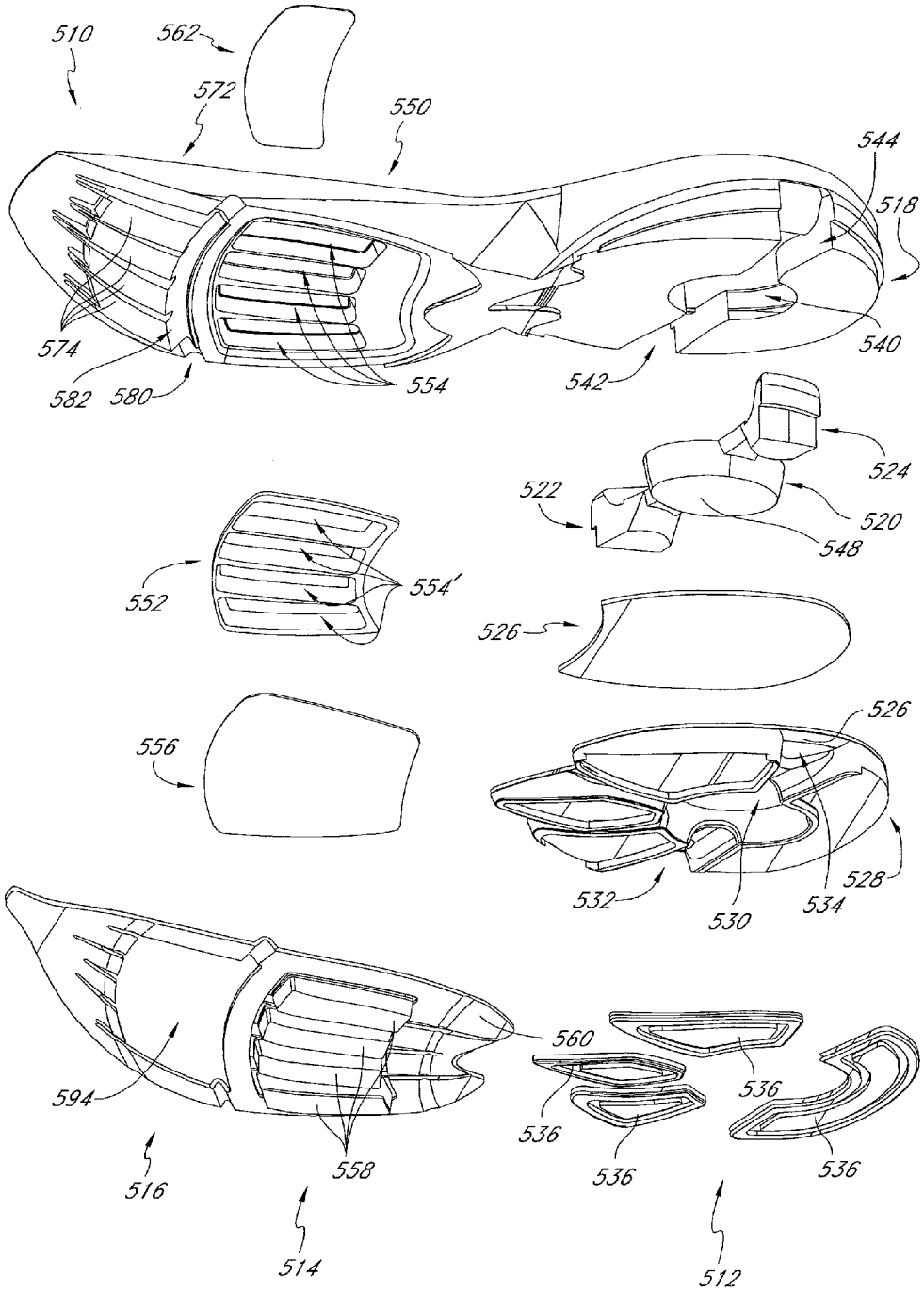
FIG. 5A is an exploded bottom perspective view of a sole construction similar to FIG. 1 in accordance with another embodiment.
Figure 7:
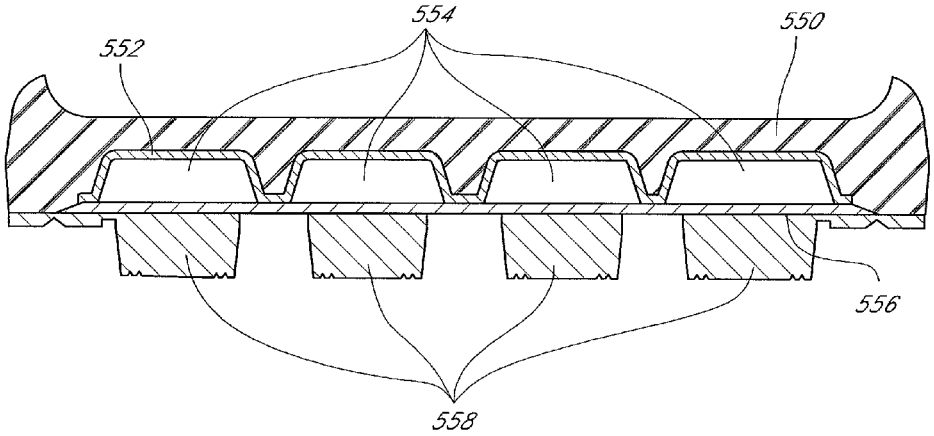
FIG. 7 is a cross-sectional view of the metatarsal region of the sole construction of FIG. 5A, along the line 7-7 shown in FIG. 2.

The lining layer 552 may be formed over a portion of the bottom surface of the foundation layer 550, as shown in FIGS. 5A and 7, and may be formed from a rigid material such as PEBAX®, nylon, carbon fiber, graphite, or EVA. The lining layer 552 supports and reinforces chambers 554, described below. In some embodiments, the lining layer may have beam-like sections between the chambers to maintain the integrity of chambers 554, described below. These sections may be solid or partially hollow having, for example, a generally I, V, or U shape cross section. In one embodiment, the lining layer 552 is formed from clear molded rigid EVA sheet and may be about 1.5 mm thick. The lining layer 552 may be omitted in some embodiments, the chambers 554 being formed in and defined by the foundation layer 550.

The chambers 554 (shown in FIGS. 5A and 7-8) may be elongated in a generally posterior-to-anterior direction and may underlie or substantially underlie the metatarsal region 514. In some embodiments, the chambers 554 may also underlie the toe region 516.

The chambers 554 may be recessed into the bottom surface of the foundation layer 550. The chambers 554 are independent from one another allowing the sole 510 to be more adaptable in the metatarsal region 514. In one embodiment, four substantially parallel chambers 554 substantially underlie the metatarsal region 514. In some embodiments, more or less than four chambers may be used. In one embodiment, each of the chambers is generally rectangular, with a generally constant width of foundation layer material between each chamber. The chambers may be similar in shape, though in some embodiments, chambers toward the medial side of the sole may be longer than chambers on the lateral side. The length of the chambers will depend upon the size of the wearer's foot and whether the chambers underlie or substantially underlie the metatarsal region 514, the toe region 516, or both. For example, in some embodiments, the length of chambers 554 may be about 32 mm or less to about 46 mm or more. In one embodiment, the chambers are about 5 or 6 mm deep or more to provide more vertical travel and better energy storage and return. In other embodiments, the depth of chambers 554 may range from about 2 mm or less to about 12 mm or more, depending on the application of the footwear and the amount of vertical travel desired.

Figure 4A:
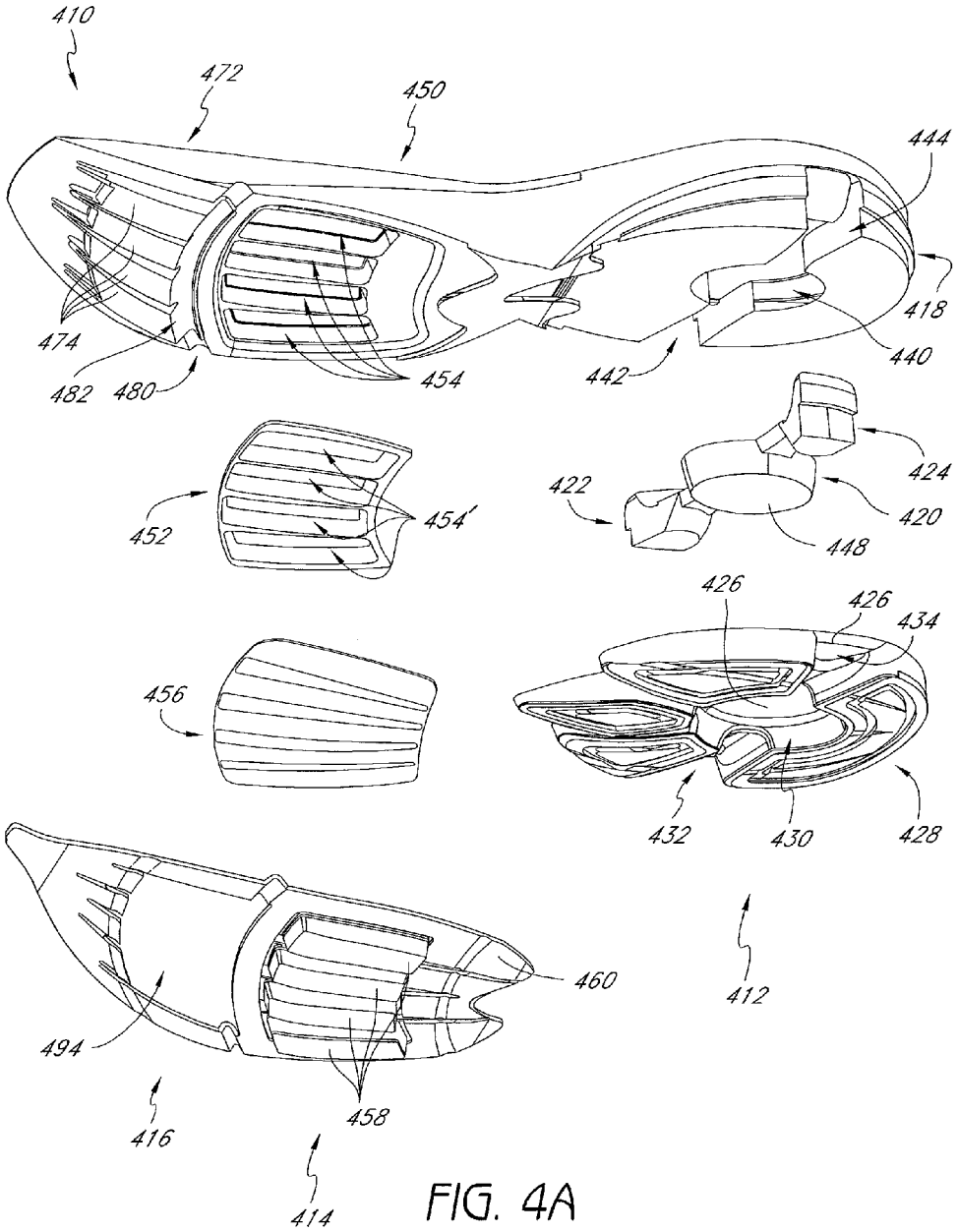
FIG. 4A is an exploded bottom perspective view of a sole construction similar to FIG. 1 in accordance with another embodiment.
Figure 4B:
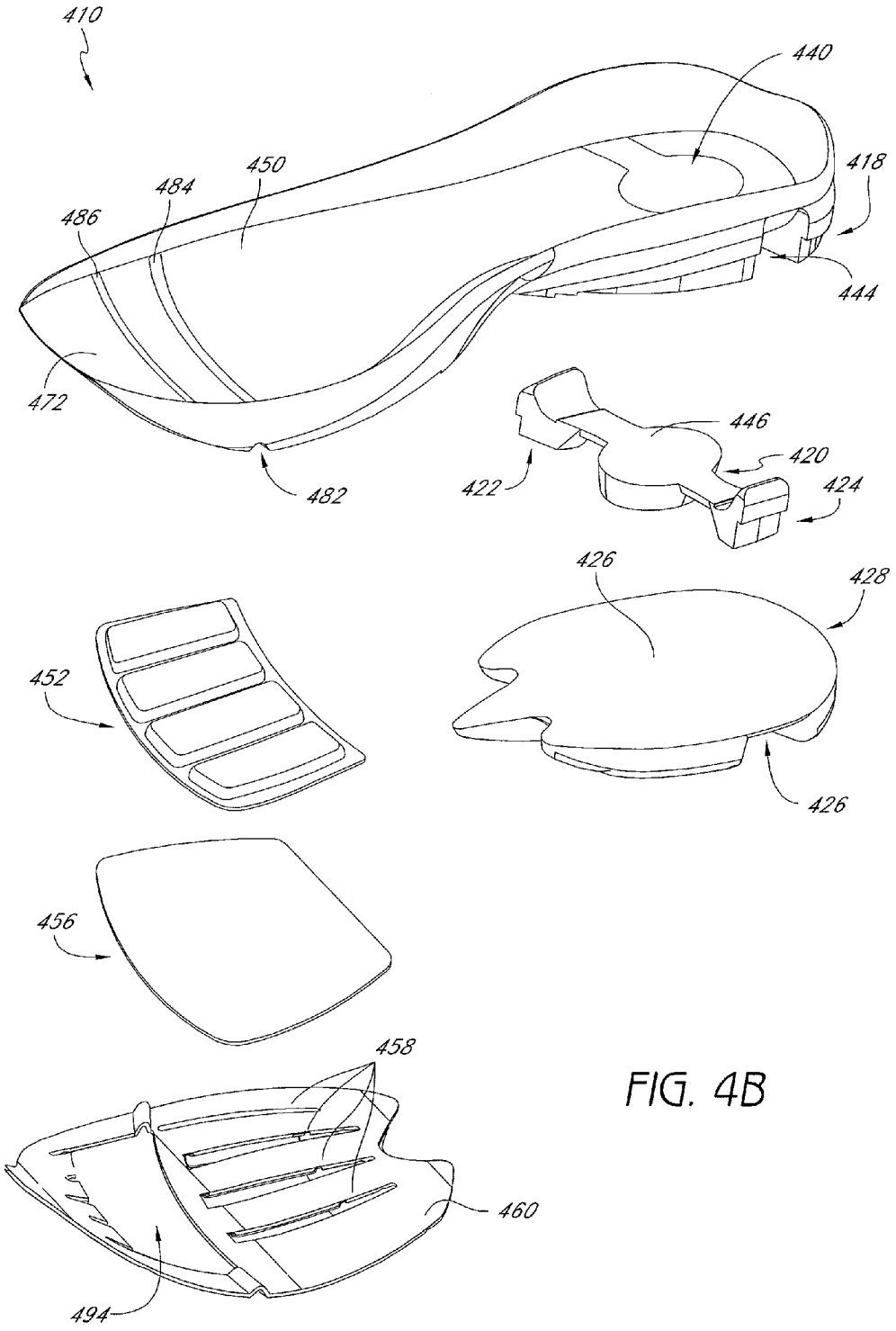
FIG. 4B is an exploded top perspective view of the sole construction of FIG. 4A.

The elastic membrane 556 preferably underlies the chambers 554, and preferably spans the entire or substantially the entire width of the wearer's foot. The elastic membrane may be made of any highly resilient elastic material such as rubber, synthetic rubber, DuPont Hytrel™, and highly resilient elastic foams. The elastic response of the membrane 556 depends on its durometer and thickness. In one embodiment, the membrane 556 is preferably about 1.2 mm thick DuPont Hytrel™. In other embodiments, the thickness of the elastic membrane 556 may range between about 0.5 mm or less to about 4 mm or more, including 1 mm, 1.5 mm, 2 mm, 3 mm, and 3.5 mm. The elastic membrane 556 may range in hardness from about 20 to about 45 Shore D, including 25, 30, 35, and 40 Shore D. The selection of hardness and thickness depends on the particular application of the shoe, including the weight of the wearer and the desired range of travel of the actuators into the chambers. In some embodiments, the thickness of the membrane 556 may vary across its length and width. For example, as shown in FIGS. 3A and 4A, an area of the elastic membrane 356, 456 that generally corresponds to the perimeter of an actuator 358, 458 may be thicker than other areas of the membrane 356, 456 to ensure proper alignment of the actuators 358, 458 with the chambers 354, 354', 454, 454'. The elastic membrane may include a width-wise protrusion on its upper surface which engages a width-wise groove in the foundation layer behind the chambers 554 to hold the elastic membrane in place, and may also include a corresponding groove on its lower surface to facilitate efficient flexure of the membrane in the region of the protrusion. In some embodiments, the elastic membrane 556 may be attached to the lining layer 552 and/or the foundation layer 550 in regions between the chambers 554 to reduce the effect of stretching a region of the membrane 556 into one chamber 554 on regions of the membranes 556 corresponding to other chambers 554.

Figure 2:
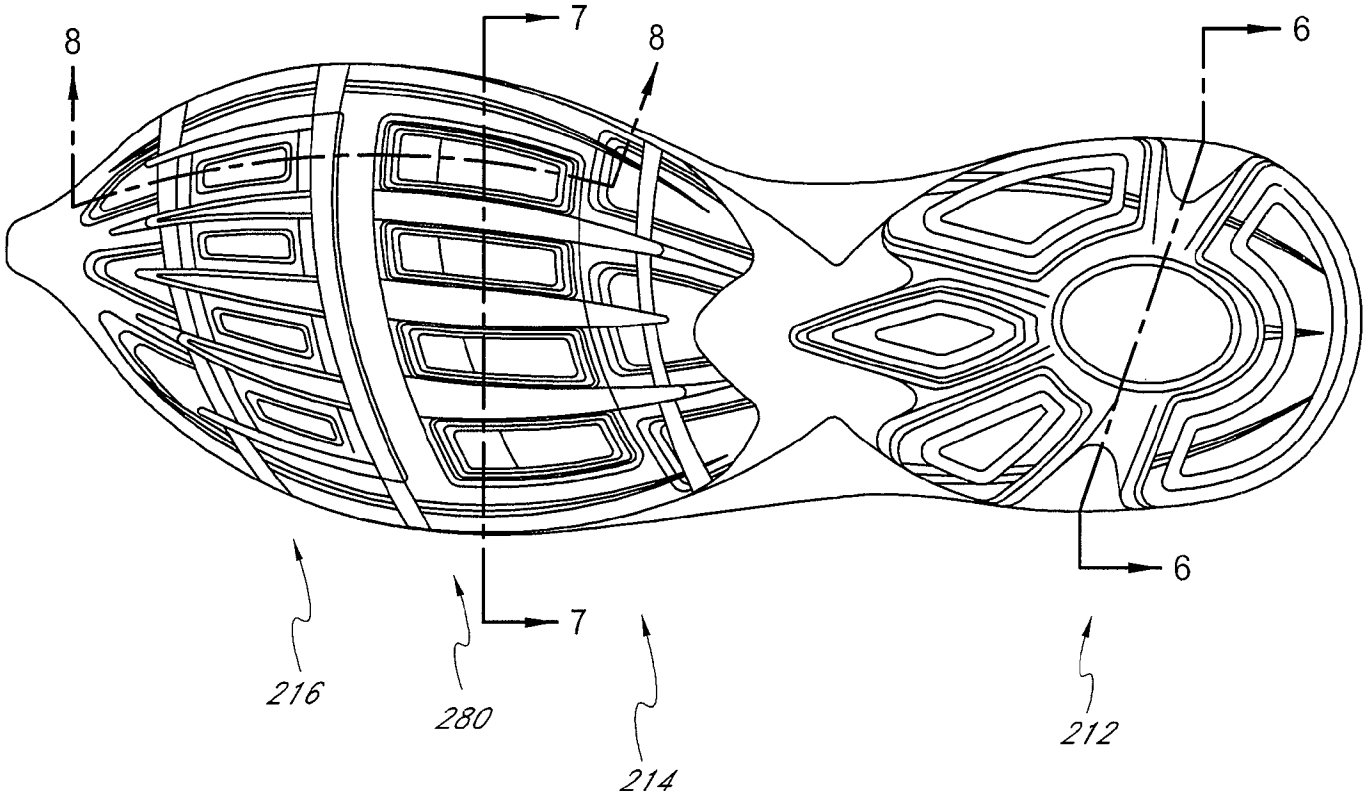
FIG. 2 is a bottom view of a sole construction similar to FIG. 1 in accordance with one embodiment.

In one embodiment, four actuators 558 underlie or substantially underlie the four chambers 554. The actuators 558 operatively engage the elastic membrane 556 and may attach directly to the membrane 556. The actuators 558 may be directly attached to the membrane 556 by adhesives, for example. Each actuator 558 may be centered under an independent chamber 554. In one embodiment, the actuators 558 are elongated from rear to forefoot and are rectangular. In other embodiments, the actuators 558 (as well as the chambers) may be rounded, pointed, or have other shapes depending on the particular application for the sole. In some embodiments, the actuators 158 may have a flex groove (as shown in FIG. 1, not shown in FIG. 2) extending laterally across the actuators 558 to allow the actuator to flex as pressure is applied.

In one embodiment, the actuators 558 are preferably about 7.2 mm thick. In another embodiment, the actuators 558 are preferably about 6.5 mm thick. In other embodiments, the actuators 558 may range in thickness from about 2 mm or less up to about 12 mm thick or more, depending on the application of the footwear and the amount of vertical travel desired.

The actuators 558 in one embodiment cooperate with chambers 554 to provide a forward levering action. As pressure is transferred from the heel region 512 to the metatarsal region 514, the actuators 558 preferably move vertically into the chambers 554. The rear end 566 of actuators 558 is preferably compressed first followed by compression of the front ends 568 of actuators 558. As pressure continues to be transferred farther forward, the rear end 566 of actuators 558 will preferably rebound before front ends 568 of actuators 558. In conjunction with a beveled front edge 570 of the actuators 558, this levering action preferably creates less resistance to forward propulsion and allows the stored energy to be transferred in a forward direction.

Figure 5B:
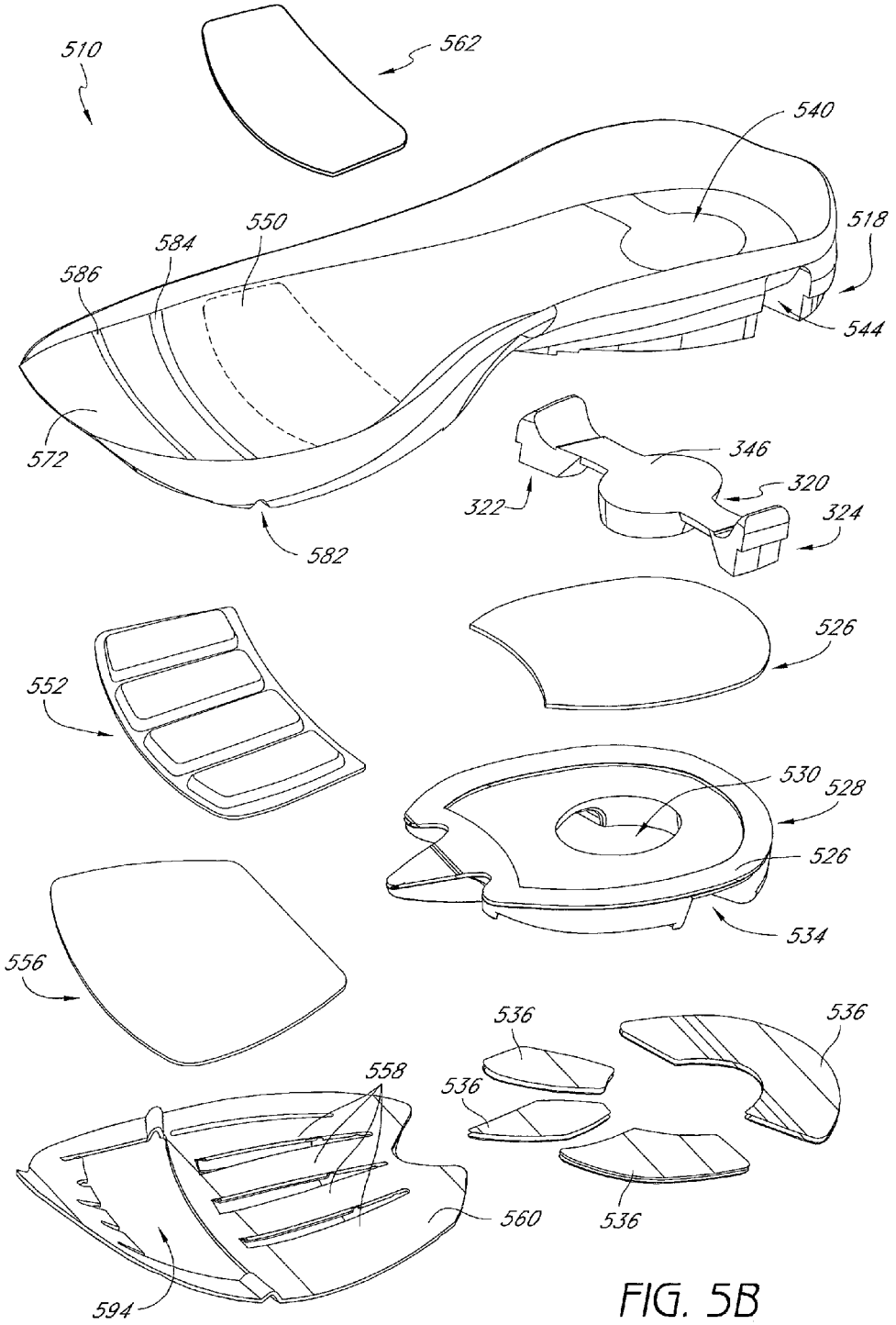
FIG. 5B is an exploded top perspective view of the sole construction of FIG. 5A.

A webbing 560 may also be provided in the metatarsal region. The webbing 560 may be composed of rubber or other durable material. As illustrated in FIGS. 5A and 5B, the webbing 560 may be integral with actuators 558, extending beside, rearward and forward of the actuators 558 and indirectly connecting the actuators together. The webbing is preferably thinner than the actuators 558, which themselves directly contact the ground in the illustrated embodiment, thereby allowing the actuators 558 to extend into the chambers 554. In one embodiment the thickness of the webbing 560 is generally about 1.5 mm, though the thickness may vary over the length and breadth of the webbing. As described further below and illustrated in FIGS. 3A and 3B, the webbing 360 may be formed integrally with ground engaging elements 378, as shown in the toe region 316. With renewed reference to FIGS. 5A and 5B, the webbing 560 may have apertures located between the actuators 558 which expose the flexible membrane 556. These apertures between the actuators 558 may reduce the interaction between adjacent actuators 558 to facilitate independent actuation of the actuators 558. As described further below, in some embodiments the webbing 560 may have an aperture 594 through which toe pads 574 may extend. These apertures in webbing 560 allow the weight of sole to be reduced. In some embodiments, the webbing may completely cover the elastic membrane.

As shown in FIG. 5B, the forefoot biomechanical top plate 562 may, in some embodiments, be located above the foundation layer 550 in the metatarsal region 514, extending substantially over the area where the chambers 554 are located. The top plate 562 may be composed of a rigid but flexible material, such as carbon fiber or thermoplastic urethane (TPU). The top plate 562 advantageously distributes pressure across the sole 510, stabilizes the metatarsals in the forefoot, forces the expansion and energy return to work from the ground up, and improves afferent feedback to the central nervous system.

In some embodiments, the sole may include one or more stiffening elements (not shown). A stiffening element may be located within an actuator or between an actuator and the elastic membrane. Stiffening elements may be made of metal, rigid plastics, carbon fiber or other rigid materials. Stiffening elements preferably stiffen the actuators to improve the levering action by speeding movement into and out of chambers. Stiffening elements may be visible in the forefoot with the use of transparent materials.

In one embodiment, the toe region may, like the metatarsal region, have chambers and actuators separated by an elastic membrane. In another embodiment, chambers and actuators are not used to reduce weight of the sole 510. The toe region 516 may include a foundation layer 572 which underlies or substantially underlies the toe region of a wearer's foot side-to-side and posterior-to-anterior. The foundation layer 572 may be separate from or integral with the foundation layers 550 and 518 described above. The foundation layer 572 shown in FIGS. 5A and 8 has pads 574 preferably aligned with actuators 558 in the metatarsal region 514. The pads 574 are generally slightly wedge-shaped permitting a smooth transition as pressure is transferred from the metatarsal region 514 to the toe region 516. The pads extend downward from the bottom surface of the foundation layer 572, such that the foundation layer is thicker in the location of the pads. Each pad is preferably separated from each other, and in the embodiment shown, there are four generally rectangular pads. The pads may be beveled along their front edge to provide a smooth transaction as the sole moves from heel to toe. The thickness of the pads generally depends upon the size and range of travel of the actuators 558 underlying the metatarsal region 514. In some embodiments, the pads may be about 1 mm or less to about 8 mm or more thick at their thickest point. In one embodiment, the pads are about 3.7 mm thick at their thickest point. In some embodiments, the pads 574 may extend through the aperture 594 in webbing 560 to directly contact the ground.

In one embodiment, shown in FIGS. 3A and 3B, the toe region 316 may further include grounding engaging elements 378 that may underlie each of the pads 374. The ground engaging elements 378 may be integrally formed with the webbing 360 in the metatarsal region, and may be similarly composed of rubber or other durable material. In one embodiment, the thickness of the ground engaging elements 378 is about 1.5 mm. When the ground engaging elements 378 and webbing 360 are formed integrally, the integrally formed component may include apertures on either side of each ground engaging element 378. In some embodiments, such as those illustrated in FIGS. 4A and 5A, the webbing 460, 560 can have one or more openings 494, 594 through which the pads 474, 574 extend, which may reduce the weight of the sole.

Figure 8:
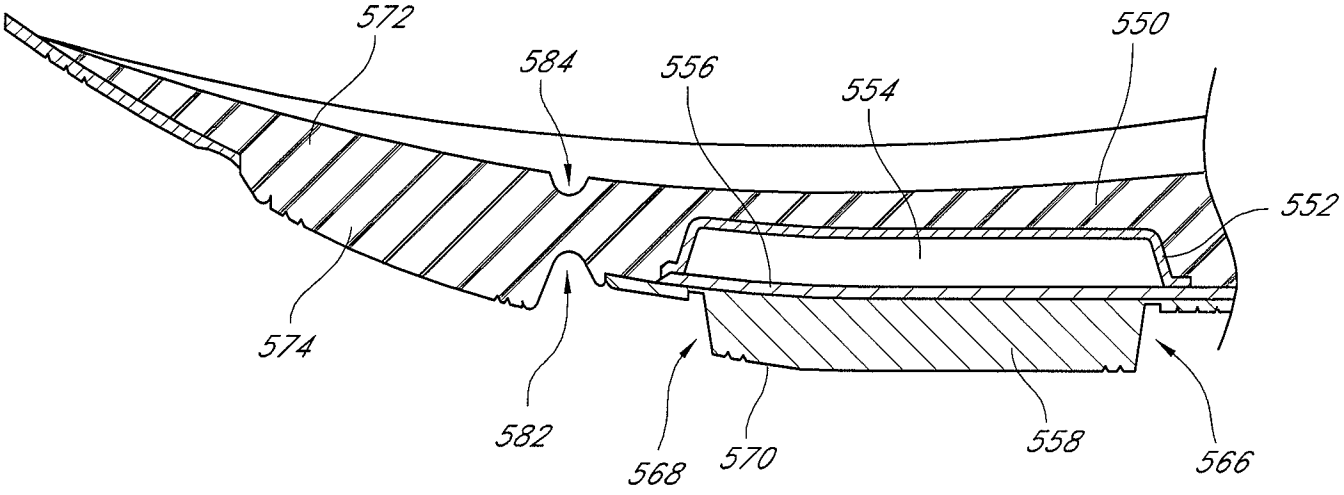
FIG. 8 is a partial cross-sectional view of the metatarsal and toe regions of the sole construction of FIG. 5A, along the line 8-8 shown in FIG. 2.

In one embodiment, as illustrated in FIGS. 5A and 5B, the sole 510 includes a flex region 580 having a lower flex groove 582 extending from side-to-side located between the metatarsal region 514 and the toe region 516. The lower flex groove 582 may be curved to generally underlie the region between the metatarsal heads and the toes of a human foot. The webbing 560 may in some embodiments extend into a portion of the lower flex groove 582. In another embodiment, illustrated in FIGS. 3A and 3B, the webbing 360 may extend into the lower flex groove 382 along substantially all of the length of groove 382. The flex region 580 may also include an upper flex groove 584 on the top surface of the foundation layer, as shown in FIGS. 5B and 8. The upper flex groove 584 may substantially overlie the lower flex groove 582. The flex region 580 in one embodiment facilitates bending to permit natural movement of final propulsion from the foot and limit energy consumption from bending in the shoe. In one embodiment, as shown in FIG. 9, the sole may include a flex groove 986 passing under a wearer's toes.

Figure 9:
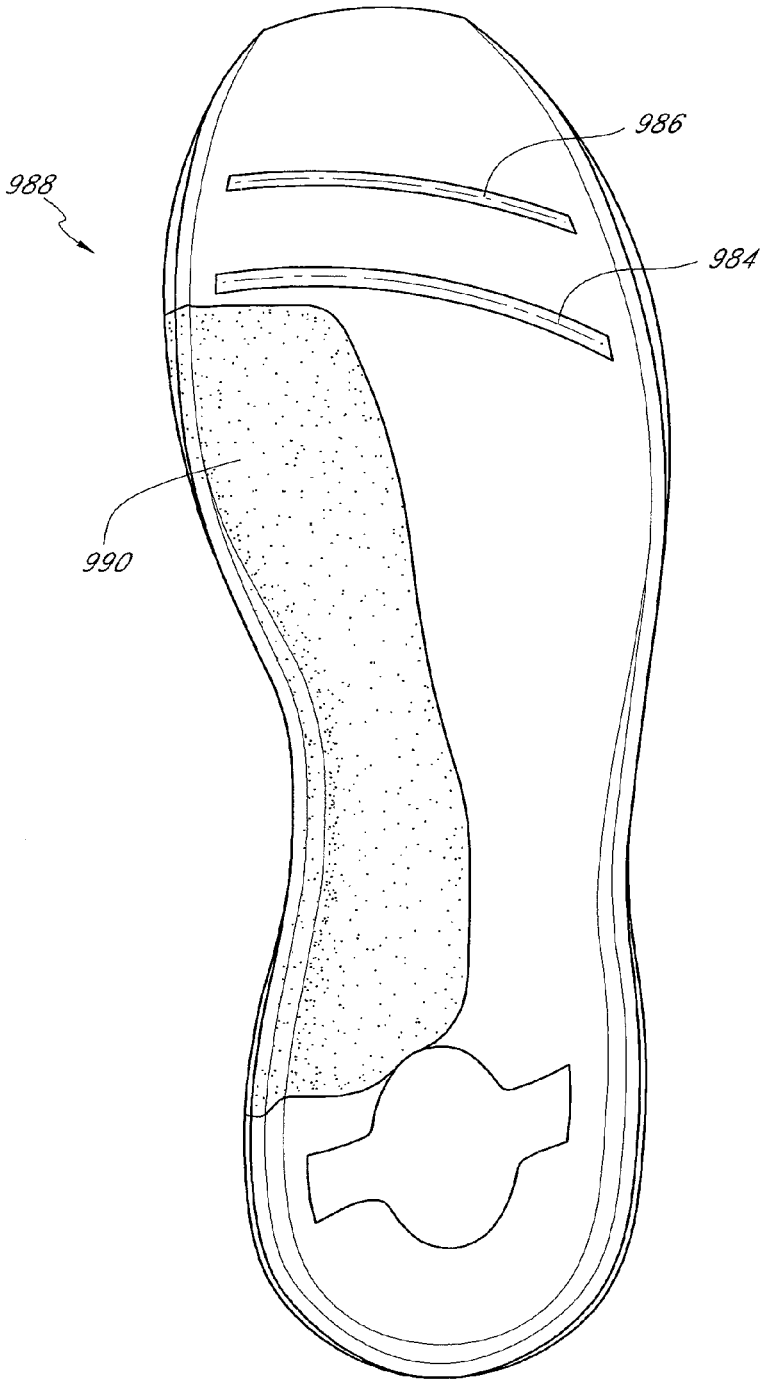
FIG. 9 is a top view of a foundation layer in accordance with one embodiment.
Figure 10:
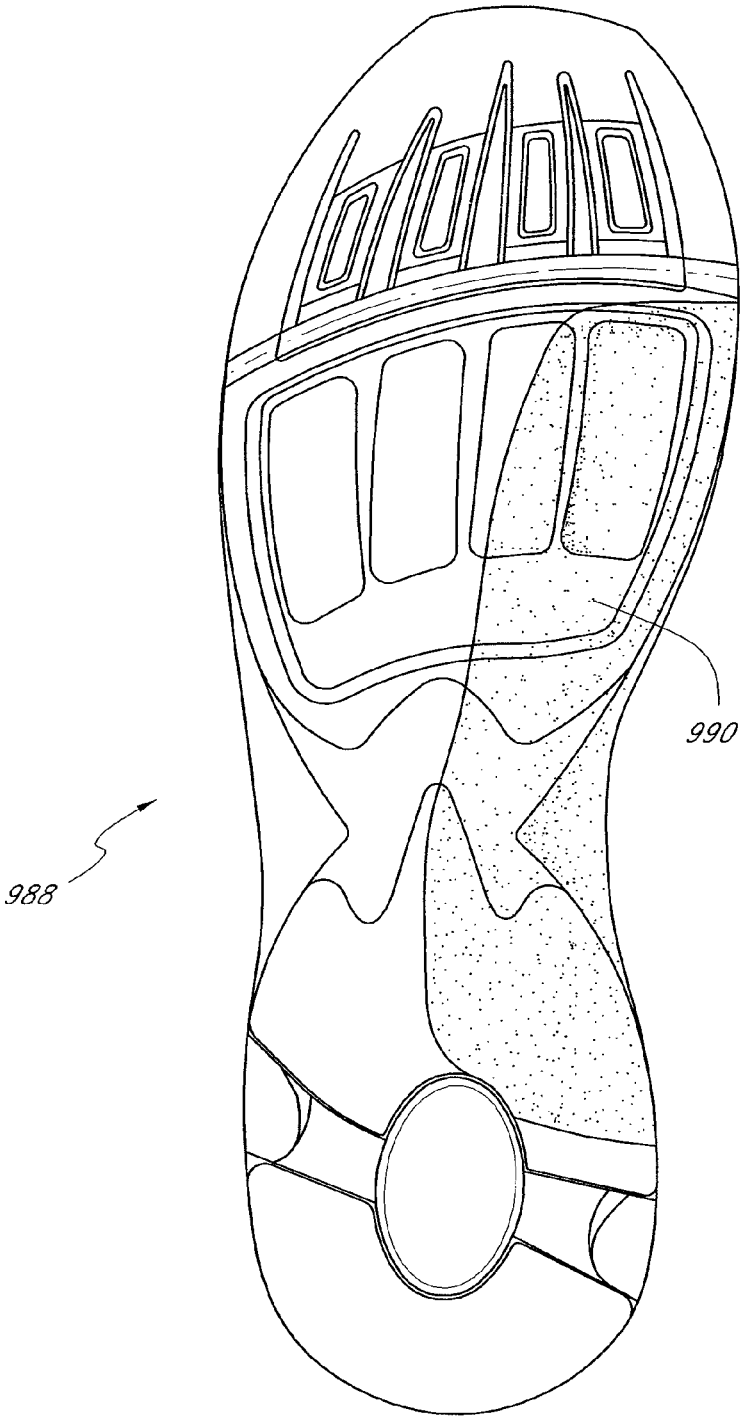
FIG. 10 is a bottom view of the foundation layer of FIG. 9.
Figure 11:
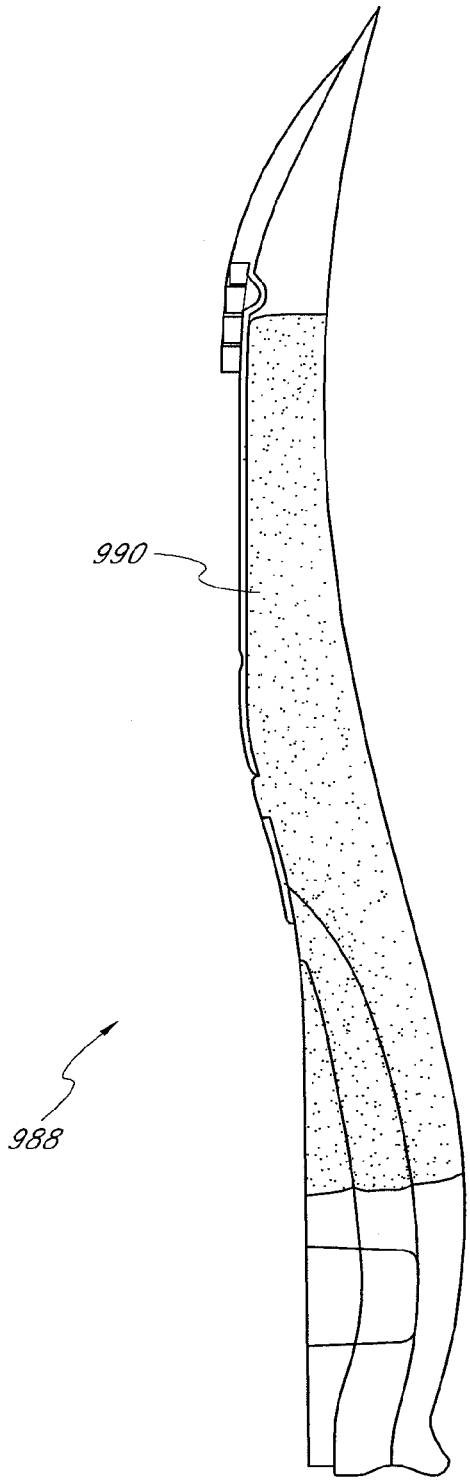
FIG. 11 is a side view of the foundation layer of FIG. 9.

In one embodiment, referring to FIGS. 9-11, a variable density foam may be used for the foundation layer 988. The foundation layer 988 underlies the entire foot of a wearer, but includes different densities to provide desired support as needed. For example, harder or denser foam may be used in one or more regions 990, such as on a medial side of the foot, extending between the heel and toe region. As shown in FIG. 10, harder, denser or different foam may extend through one or more chambers of the metatarsal region. In other embodiments, harder or denser foam may be used in various lateral or medial regions to resist late stage pronation or supination during the propulsive portion of the gait cycle. The harder foam may range in hardness, in some embodiments, from about 65 Shore C or less to about 75 Shore C or more. In yet other embodiments, different components may be made with a different hardness or density. For example, the elastic membrane of the metatarsal and/or heel region may be made with different densities in different regions to provide desired properties.

Figure 6B:
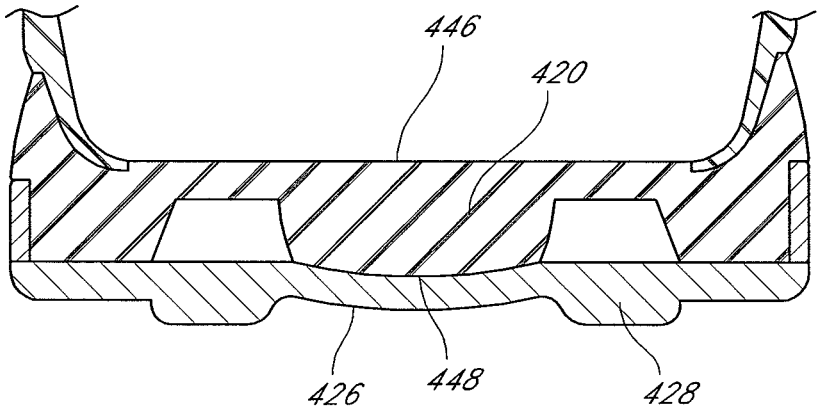
Figure 6C:
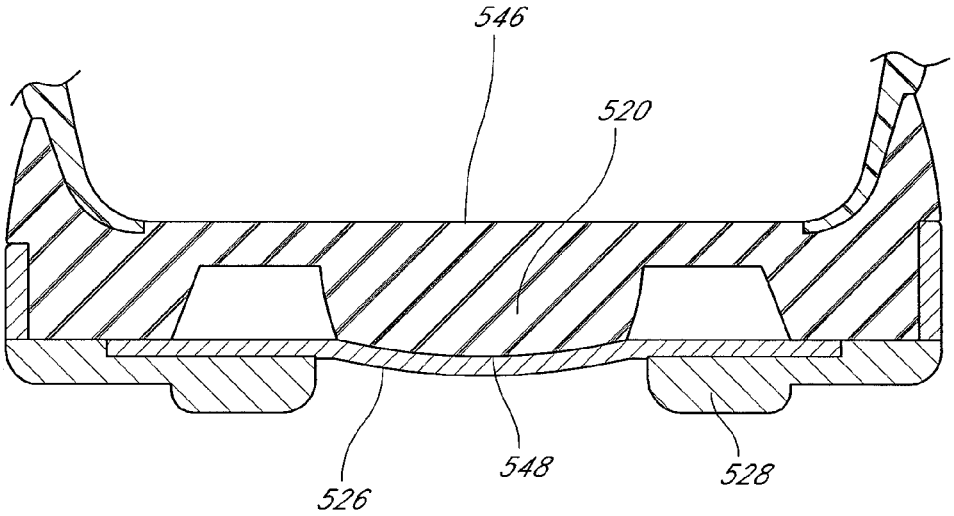

The various embodiments described above provide a number of ways to carry out the invention and may be employed in various combinations. For example, in one embodiment, a sole may be constructed having the heel region shown in FIGS. 5A, 5B and 6C and the metatarsal region shown in FIG. 7. In another embodiment, a sole may be constructed having the heel region shown in FIGS. 5A, 5B and 6C, the metatarsal region shown in FIG. 7, and the foundation layer shown in FIGS. 9-11. In another embodiment, a sole may be constructed having the heel region of FIGS. 4A, 4B and 6B and a metatarsal region of FIG. 7. In another embodiment, a sole may be constructed having the heel region of FIGS. 4A, 4B and 6B, the metatarsal region of FIG. 7, and the foundation layer of FIGS. 9-11. Other variations are contemplated as well.

Of course, it is to be understood that not necessarily all objectives or advantages described may be achieved in accordance with any particular embodiment described herein. Also, although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, the invention is not intended to be limited by the specific disclosures of preferred embodiments herein.

What is claimed is:

1. A sole construction for cushioning, supporting and providing energy return to a region of a foot, comprising:

a foundation layer defining a central recess;

a central actuator positioned in the central recess of the foundation layer;

an elastic membrane engaged by the central actuator on a first side of the elastic membrane, wherein the central actuator lies between the foundation layer and the elastic membrane; and a heel layer having a chamber, wherein the heel layer is located on a second side of the elastic membrane and the chamber is vertically aligned with the central actuator.

2. The sole construction of claim 1, further comprising a rigid top plate adjacent and above the foundation layer.

3. The sole construction of claim 1, wherein the foundation layer further defines peripheral recesses, further comprising:

a peripheral actuator positioned in each of the peripheral recesses of the foundation layer, wherein the elastic membrane is further engaged by the peripheral actuators on the first side thereof, and wherein the heel layer further has a plurality of chambers vertically aligned with the peripheral actuators.

4. The sole construction of claim 3, wherein the peripheral actuators include a medial actuator and a lateral actuator.

5. The sole construction of claim 4, wherein the lateral actuator is positioned forward of the medial actuator.

6. The sole construction of claim 1, wherein the central actuator is positioned above the elastic membrane.

7. The sole construction of claim 1, wherein the central actuator has a convex bottom surface.

8. The sole construction of claim 1, wherein the elastic membrane is pretensioned by the central actuator.

9. The sole construction of claim 1, wherein the heel layer is sized and positioned to underlie substantially an entire width of a heel region of a foot.

10. The sole construction of claim 1, wherein the heel layer and the elastic membrane are integrally formed.

11. The sole construction of claim 1, wherein the foundation layer includes foam.

12. The sole construction of claim 1, wherein the foundation layer has a varying density.

13. The sole construction of claim 1, wherein the elastic membrane includes two portions.

14. The sole construction of claim 13, wherein a first portion of the elastic membrane is integrally formed with the heel layer and a second portion of the elastic membrane covers one or more of the plurality of chambers.

15. The sole construction of claim 3, wherein the central and peripheral actuators are integrally formed.

16. A sole construction comprising:

a foundation layer defining a plurality of recesses;

a plurality of actuators positioned in the recesses of the foundation layer;

an elastic membrane engaged by the actuators on a first side of the elastic membrane, wherein one or more of the actuators lie between the foundation layer and the elastic membrane; and a heel layer having one or more chambers, wherein the heel layer is located on a second side of the elastic membrane and each of the chambers are vertically aligned with one of the actuators.

17. The sole construction of claim 16, wherein the heel layer and the elastic membrane are integrally formed.

18. The sole construction of claim 16, wherein the elastic membrane includes two portions.

19. The sole construction of claim 18, wherein a first portion of the elastic membrane is integrally formed with the heel layer and a second portion of the elastic membrane covers one or more of the plurality of chambers.

20. A sole construction for providing energy return to a heel region of a foot, the sole construction comprising:

a foundation layer sized and configured to receive and cradle a wearer's foot, wherein the foundation layer defines a central aperture centered in a heel region of the foundation layer;

a central actuator with a convex bottom surface positioned in the central aperture of the foundation layer;

an elastic membrane engaged by the bottom surface of the central actuator on a first side of the elastic membrane, wherein the central actuator lies between the foundation layer and the elastic membrane, and wherein the elastic membrane is pretensioned by the central actuator; and a heel layer having a central chamber, wherein the heel layer is located on a second side of the elastic membrane and the central chamber is vertically aligned with the actuator.

* * * * *